US006493016B2

(12) United States Patent
Sawano et al.

(10) Patent No.: US 6,493,016 B2
(45) Date of Patent: Dec. 10, 2002

(54) IMAGE TRANSFER RECORDING APPARATUS

(75) Inventors: Mitsuru Sawano, Kanagawa (JP); Kazuaki Kinjyo, Shizuoka-ken (JP)

(73) Assignee: Fuji Photo Film., Ltd., Kanagawa (JP)

( * ) Notice: Subject to any disclaimer, the term of this patent is extended or adjusted under 35 U.S.C. 154(b) by 0 days.

(21) Appl. No.: 10/082,121

(22) Filed: Feb. 26, 2002

(65) Prior Publication Data

US 2002/0158961 A1 Oct. 31, 2002

(30) Foreign Application Priority Data

Mar. 2, 2001 (JP) ..... 2001-058799

(51) Int. Cl.[7] ..... B41J 2/325; B41J 11/04; B41J 13/02; B41J 13/036

(52) U.S. Cl. ..... 347/172; 347/215; 346/138

(58) Field of Search ..... 346/138; 271/275, 271/276; 347/215, 216, 171, 172, 213, 224; 250/318, 319; 400/248

(56) References Cited

U.S. PATENT DOCUMENTS 5,264,867 A * 11/1993 DeCook et al. ..... 346/138
5,268,708 A * 12/1993 Harshbarger et al. ..... 346/138
5,578,824 A * 11/1996 Koguchi et al. ..... 250/318
5,699,099 A * 12/1997 Garand et al. ..... 347/172
6,219,081 B1 * 4/2001 Sasaki et al. ..... 347/213

* cited by examiner

*Primary Examiner*—Huan Tran
(74) *Attorney, Agent, or Firm*—Sughrue Mion, PLLC

(57) ABSTRACT

An image recording apparatus in which ink transfer from a donor sheet to an image-receiving sheet is carried out. The donor sheet has a size larger than the image-receiving sheet. The apparatus includes a rotating drum around which the image-receiving sheet and the donor sheet may be wound and laminated, and a squeeze roller. The squeeze roller has a middle portion with a fixed radius and a smaller radius portion at one or both ends. Outside an area for the image-receiving sheet, the drum has a first protruding mound portion with which the donor sheet is in surface-contact when the sheets are wound around the drum. A boundary of the smaller radius portion and the middle portion is positioned at an image-receiving sheet side of the first mound portion when the sheets are pressed against the drum.

11 Claims, 4 Drawing Sheets

IMAGE TRANSFER RECORDING APPARATUS

BACKGROUND OF THE INVENTION

1. Field of the Invention

The present invention relates to an image transfer recording apparatus having a rotating drum around which an image-receiving sheet and a donor sheet having a donor layer are to be wound, and a light source for irradiating the donor sheet with a light beam based on certain image information in order that donor ink in the donor layer can be transferred to an image-receiving layer of the image-receiving sheet. Donor sheets are also called ink-films, donor films or the like, image-receiving sheets are also called image-receiving films, receivers or the like, and donor layers are also called ink-layers.

2. Description of the Related Art

In the field of printing, prior to mass printing at a high speed, to save time and money, a trial printing for proof-reading is generally carried out.

There are several types of printers for such a proofreading. Among those printers, a transfer-type image recording apparatus is known in which it enables a colorful image formation although it is relatively simple and small in scale.

The above-type apparatus utilizes image-receiving sheets and donor sheets. In operation, an image-receiving sheet is wound around an exposure drum, and then, a donor sheet is wound therearound.

Thereafter, by laser-exposure, donor ink in the donor sheet is transferred onto the image-receiving sheet to thereby form an image thereon.

To complete a color image formation, the same sequence of processing is repeated with respect to a plurality of colors of donor sheets.

The key to ensuring a reliable ink transfer process is to achieve good adhesion between an image-receiving sheet and a donor sheet. If adhesion is not good due to, for example, air bubbles generated therebetween, the transfer process will be unsuccessful irrespective of how excellent the exposure process may be.

SUMMARY OF THE INVENTION

In light of the above-mentioned fact, a primary object of the present invention is to provide an image transfer recording apparatus that enables an excellent adhesion between an image-receiving sheet and a donor sheet.

To achieve the object mentioned above, according to an aspect of the present invention, there is provided an image recording apparatus in which ink transfer from a donor sheet to an image-receiving sheet is carried out, the donor sheet having a larger size than the image-receiving sheet, and the image recording apparatus including: a rotating drum around which the image-receiving sheet and the donor sheet can be laminatingly wound in this order; a squeeze roller disposed to releasably press the donor sheet and the image-receiving sheet against the drum, a middle portion in an axial direction of the squeeze roller having a substantially constant radius and a smaller diameter portion at at least one end thereof in the axial direction having a radius smaller than the radius of the middle portion; wherein the drum includes a first protruding mound portion which, when the image-receiving sheet and the donor sheet are wound around the drum, is apart from an edge of the image-receiving sheet substantially by a predetermined distance and is in surface-contact with the donor sheet, and when the squeeze roller is pressing the donor sheet and the image-receiving sheet against the drum, a boundary portion between the smaller diameter portion and the middle portion of the squeeze roller is disposed at a side of the first mound portion at which the image-receiving sheet is disposed.

The foregoing and other objects, features and advantages of the present invention will be apparent from the following description of a preferred embodiment of the invention, as illustrated in the accompanying drawings.

DESCRIPTION OF THE PREFERRED EMBODIMENTS

Figure 1:
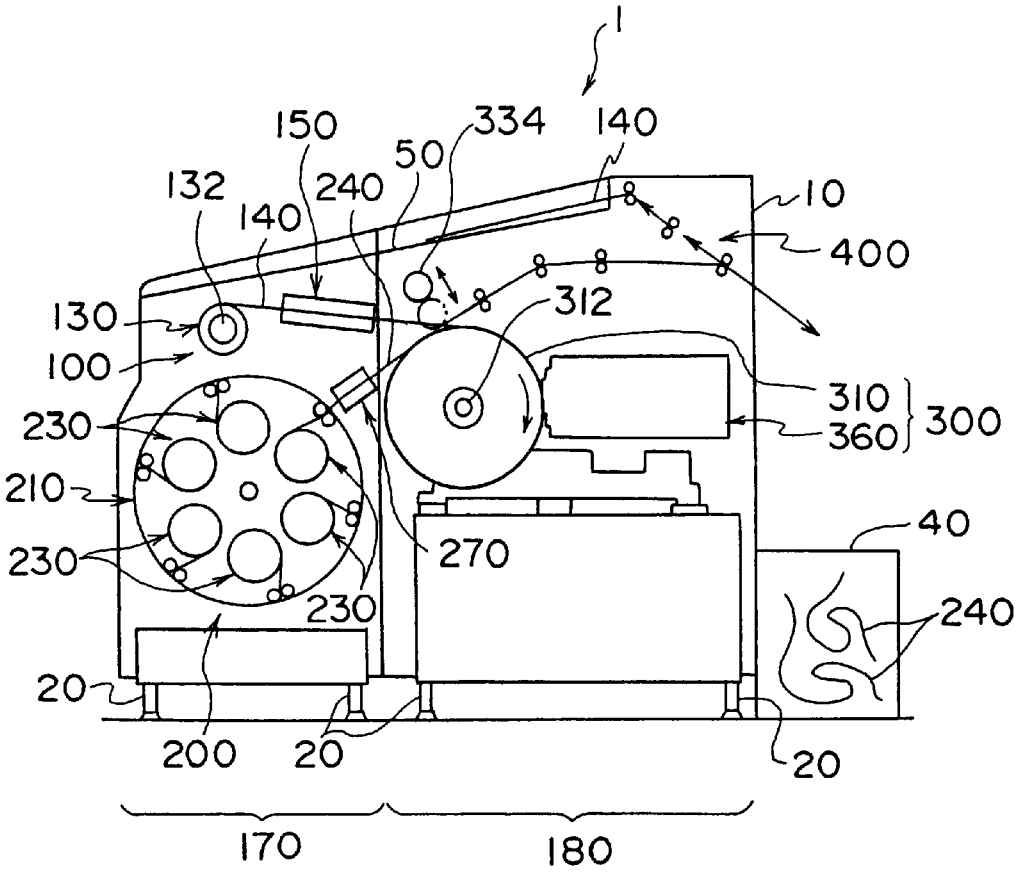
FIG. 1 is a general structural view illustrating an image transfer recording apparatus according to an embodiment of the present invention.

Referring now to the accompanying drawings, an embodiment of the present invention will be described below. FIG. 1 illustrates the schematic structure of an image transfer recording apparatus 1 according to the present embodiment. As shown in FIG. 1, the image transfer recording apparatus 1 includes an image-receiving sheet supply section 100, a donor sheet supply section 200, a recording section 300, and a discharge section 400. The image transfer recording apparatus 1 is generally covered with a body cover 10 and supported by leg portions 20.

The image-receiving sheet supply section 100 supplies image-receiving sheets 140 to the recording section 300. The donor sheet supply section 200 can supply many types of donor sheets 240 to the recording section 300 and can selectively supply one type of donor sheets from among those types of donor sheets 240 to the recording section 300. In the recording section 300, an image-receiving sheet is wound around a drum 310, and then, a donor sheet is further wound therearound. A recording head 360 irradiates the donor sheet 240 laid on the image-receiving sheet for laser-exposure with a laser beam modulated on the basis of image data to be recorded. Donor ink that has sublimated or melted in the heated area of the donor sheet 240 is transferred onto the image-receiving sheet. By sequentially transferring a plurality of different colors (e.g., yellow (Y), magenta (M), cyan (C) and black (B)) of donor inks to an image-receiving sheet, the same image-receiving sheet can have a color image formed thereon. The used donor sheets 240 are fed through the discharge section 400, where they are disposed of in a scrap box 40 which is provided (right-hand side of FIG. 1) outside the body cover 10.

On the other hand, the image-receiving sheet 140 on which the image has been formed is transferred through the discharge section 400. It is thereafter switched to move backward and ejected onto a tray 50 of an upper portion of a cover body 10. In an unillustrated lamination section that is separately arranged, the image formed image-receiving sheet is heated and pressed to an arbitrary blank sheet that is a target of printing. Thus, the donor ink in the image-receiving sheet is transferred to the target sheet for an image formation.

The image-receiving sheet supply section 100 has an image-receiving sheet roll 130 and an image-receiving sheet conveying section 150. The image-receiving sheet roll 130 includes a core 132 around which an image-receiving sheet 140 is wound. The image-receiving sheet 140 comprises a support layer and an image-receiving layer which is laminated on the former. Around the image-receiving sheet roll 130, the image-receiving sheet is wound in such a manner that the image-receiving layer is located outer side of the support layer. Further, the image-receiving sheet roll 130 is disposed to be rotatable about a center axis of the core 132.

In the illustrated embodiment, the image transfer recording apparatus 1 has a rotary rack 210 with six donor sheet rolls 230 incorporated therein. As six kinds of donor sheets corresponding thereto, four colors (i.e., yellow, magenta, cyan and black) of donor sheets and two special colors (i.e., gold, silver, specific combination color or the like) of donor sheets can be used.

The rotary rack 210 also has a plurality of donor sheet feeding mechanism by which desired kinds of donor sheets are sent from the donor sheet roll 230 toward a donor sheet conveying section 270.

The embodied image transfer recording apparatus 1 is composed of a film loader unit 170 and a recording unit 180, which units are detachable one another.

Figure 2:
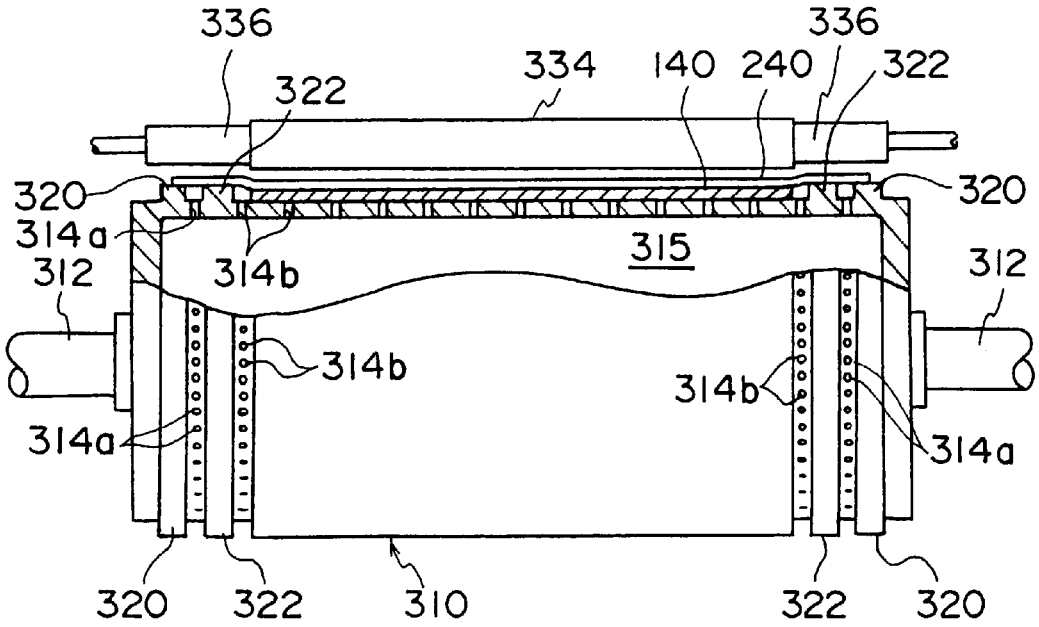
FIG. 2 is a partly sectioned, side view of a structure of a rotating drum.
Figure 3:
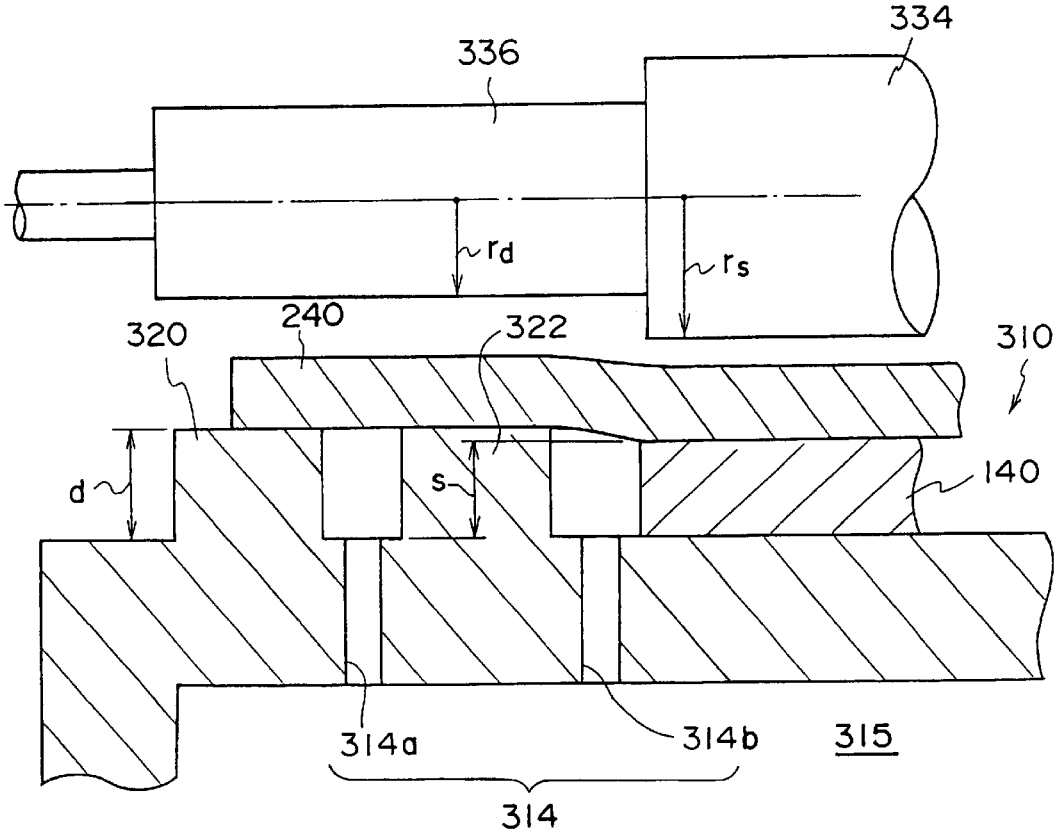
FIG. 3 is an enlarged detail fragmentary view of the rotating drum with mound portions formed thereon.
Figure 4:
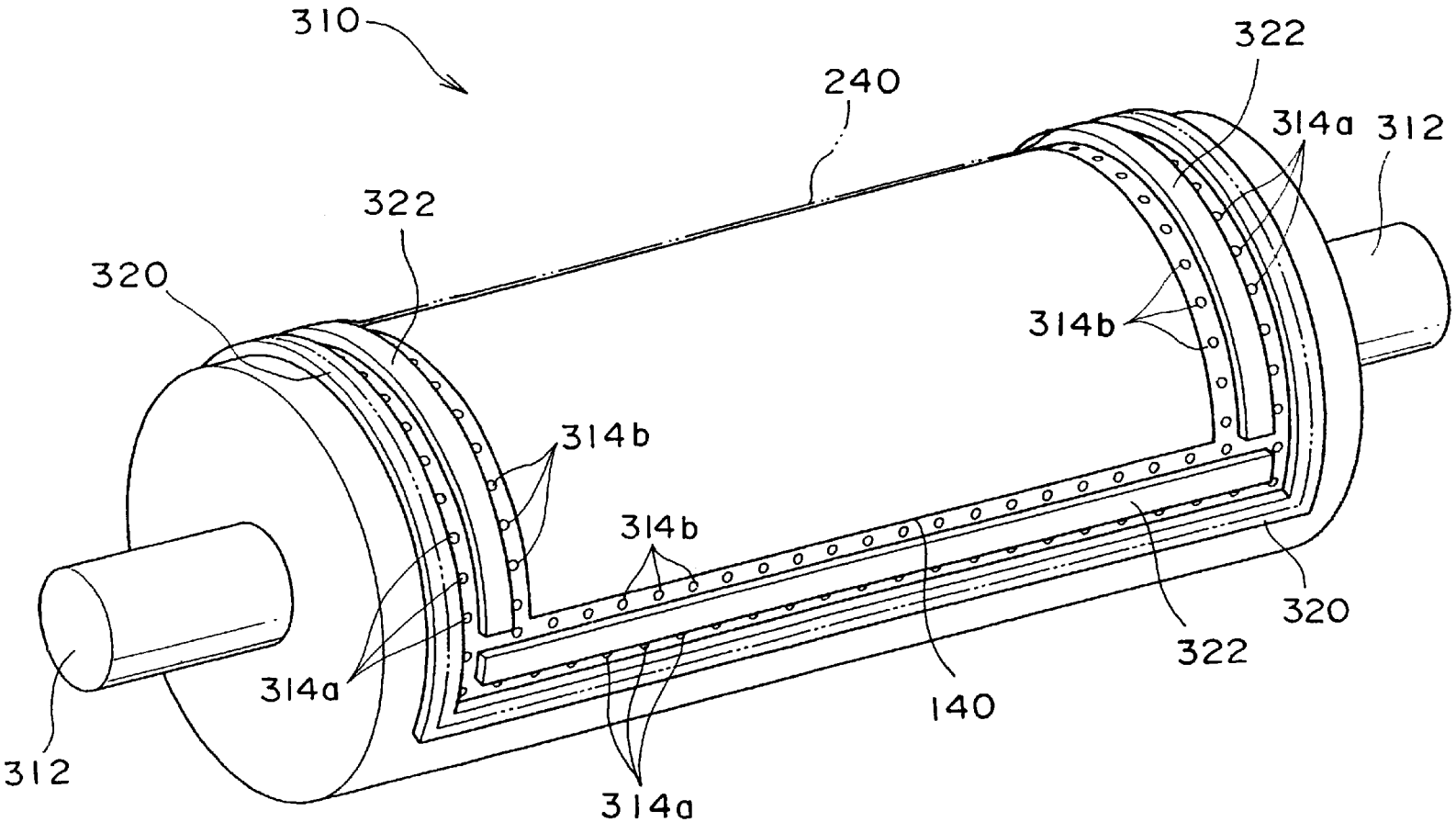
FIG. 4 is a perspective view of the rotating drum.

As shown in FIGS. 2 to 4, the drum 310 of the recording section 300 has a hollow cylindrical shape and is rotatably supported by an unillustrated frame. The drum 310, which has a rotation shaft 312 that is connected to a motor, is driven for rotation by the motor. The drum 310 generally has a diameter in the order of about 200 mm to about 500 mm.

In a peripheral surface of the drum 310 is formed a plurality of through-holes 314 (314*a*, 314*b*) each of which is communicated with an inside space section 315 of the drum 310. The inside space section 315 of the drum 310 is structured to be supplied through an inner space of the rotation shaft 312 with a reduced pressure generated by movement of an unillustrated blower. Therefore, the structure is such that the air outside the drum 310 can be sucked through the through-holes 314 into the inside space section 315. Alternatively, a plurality of circumferentially extending grooves can be formed in the peripheral surface of the drum 310, with each groove having at least one through-hole.

The drum 310 has mound portions 322, 320 protruding from the peripheral surface thereof. Among those mound portions, one pair of mound portions 322 are separately disposed at respective sides in a drum longitudinal direction and extend in a peripheral direction of the drum 310. Another pair of mound portions 322 are separately disposed at respective sides in drum peripheral direction and extend in a direction parallel to a drum axial direction. Outside of those pairs of mound portions 322 is disposed a closed-loop-shaped mound portion 320 which comprises one pair of mound portion parts separately disposed and extending in the drum peripheral direction and another pair of mound portion parts separately disposed and extending in the drum axial direction. The through-holes 314*a* are disposed between respective ones of mound portions 322 and the mound portion 320.

The mound portions 322 surround a saddle-like surface portion (of the drum peripheral surface) onto which the image-receiving sheet 140 is to be detachably and closely attached. On the other hand, the donor sheet 240 has a size larger than the image-receiving sheet 140. When the donor sheet 240 is wound around the drum 310, the donor sheet 240 is entirely contacted on its periphery by the mound portion 320.

In the present embodiment, the mound portions 320, 322 are integral with the drum 310. However, a structure is possible in which those portions are detachably attachable to the drum 310. A suitable member or sheet can be interposed between an image-receiving sheet and the peripheral surface of the drum when the image-receiving sheet is wound around the drum.

At a predetermined location around the drum 310 is provided a squeeze roller 334 which may move towards or away from the drum 310. When the image-receiving sheet 140 or the donor sheet 240 is wound around the drum 310, the squeeze roller 334 has a role of pressing the sheet toward the drum 310, thereby making the sheet in close contact with the peripheral surface of the drum 310.

In the present embodiment, the squeeze roller 334 is provided with a smaller diameter portion 336 at each end in an axial direction thereof. The smaller diameter portions 336 are located at respective positions corresponding to the mound portions 320, 322.

Referring now to FIG. 3, the radius ($r_d$) of the smaller diameter portions 336 is set based on the radius ($r_s$) of a middle portion in the axial direction of the squeeze roller 334 with the middle portion being opposed to a drum surface portion between the mound portions 322, the height (d) of the mound portions 320, 322, and the thickness (s) of the image-receiving sheet 140.

It is desirable that each boundary between the smaller diameter portions having radius ($r_d$) and the middle portion having the radius ($r_s$), of the squeeze roller 334 is located in the vicinity of a respective side edge of the image-receiving sheet 140. If, for example, one boundary shifts away from the sheet edge position and nearer to the right-hand side of FIG. 3, it can brought about a loss of sheet edge pressure thereby causing poor adhesion of the sheet edge to the drum. The same can be said if the boundary shifts beyond the sheet edge position and nearer to the left-hand side of FIG. 3. The height (d) of the mound portions 320, 322 is the same as or greater than the thickness (s) of the image-receiving sheet 140.

Referring to FIG. 1, the recording head 360 can irradiate a donor sheet 240 with a light beam or laser beam, and thereby a donor ink in the irradiated donor sheet area may be transferred onto a surface (an image-receiving layer) of an image-receiving sheet 140.

Further, the recording head 360 can be linearly moved by an unillustrated drive mechanism in a direction parallel to the rotation shaft 312 of the drum 310. Accordingly, on a basis of a combination of the rotary motion of the drum 310 and the linear motion of the recording head 360, any desired portion of the donor sheet wrapped round the image-receiving sheet can be laser-exposed. Thus, scanning of the donor sheet with a laser beam, which is a light beam for drawing, and then laser-exposing of only portions corresponding thereto on a basis of image information would enable any desired image to be formed or transferred onto an image-receiving sheet.

Next, description will be given of an operation of the present embodiment.

Firstly, an image-receiving sheet with a thickness of 150 $\mu$m is pulled out, and thereafter, a piece of sheet having a predetermined length is cut therefrom and then conveyed to the recording section 300. In the recording section 300, the conveyed sheet piece 140 is wound around the drum 310 while being pressed to the drum 310 by the squeeze roller 334, under the squeeze roller's own weight (4.5 kg). The squeeze roller 334 comprises a stainless shaft and a silicone rubber layer formed around the shaft, with the layer being formed by rubber coating and having a thickness of approximately 3.5 mm and a hardness of approximately 40° Shore "A".

The image-receiving sheet 140 is wound around a drum peripheral surface portion which is surrounded by the mound portions 322 on its four sides and which looks like a semi-cylindrical surface (see FIG. 4). This drum peripheral surface portion has an area slightly larger than the image-receiving sheet such that when the image-receiving sheet is wound around the drum, circumferential small areas on four sides of the drum peripheral surface portion may be kept not wound over by the image-receiving sheet.

On or before the winding of the image-receiving sheet, suction through the through-holes of the drum starts in order to make the image-receiving sheet adhere onto the drum surface. In any case, the image-receiving sheet 140 can be fixedly wound around the drum surface while being suction-adhered as the drum rotates.

Next, a piece of donor sheet having a predetermined length is cut off from the donor sheet and then conveyed to the recording section 300. Thereat, the conveyed donor sheet piece is wound around the drum 310 by the squeeze roller 334 while being pressed to the drum 310.

Two types of sheets, i.e., the image-receiving sheet 140 and the donor sheet 240 are different from one another in dimensions. The donor sheet 240 is larger than the image-receiving sheet 140 with respect to both vertical and horizontal directions thereof. The dimension of the donor sheet 240 is such that, when the donor sheet 240 is wound around the drum 310, four side edges of the donor sheet 240 each reach the outermost mound portion 320 of the drum 310. Therefore, the donor sheet can be fixedly attached to the drum 310 by being sucked through the through-holes 314 disposed between the mound portions 320 and 322.

When being wound around the drum 310, the image-receiving layer of the image-receiving sheet 140 and the donor layer of the donor sheet 240 are in closely contact state under high pressure. After the above winding sequence, the drum is started in rotation at a high speed (at generally 400 to 800 rpm). The donor ink is transferred to the image-receiving layer of the image-receiving sheet 140 by laser-exposure by means of the recording head 360 being moved along the drum axial direction during high speed rotation of the drum 310.

In the present embodiment, the image-receiving sheet 140 and the donor sheet 240 can be pressed to the drum under respective optimum pressure.

Evaluation was carried out on adhesiveness and air leakage. Table 1 shows the result thereof.

EXAMPLES

1. Adhesion Test

In the test, several types of squeeze rollers (Luxel Final Proof Cp-5600 (for domestic use) manufactured by Fuji Photo Film Co. Ltd) were used. Mound portions were formed of adhesive tapes having different thickness. Standard-type Image-receiving sheets and donor sheets for domestic use were used.

The film loader unit 170 is inclined with the left side portion thereof is lower than the right side portion by approximately 5 mm. This is because such a structural setting is useful to make (a) poor adhesive portion(s) outstanding or recognition among others.

A plurality of sheets (B2 size, Full Surface 50% Half Tone) of multicolor (i.e., four colors: K, C, M and Y) image were printed by PD system manufactured by Fuji Photo Film Co. Ltd.

The number of image-receiving sheets having a poor recording portion (whose size is over 1 cm) was counted and the ratio, i.e., the number of poor sheets/the number of test sheets was calculated.

2. Air Leak Test

Air leak level can be estimated by listening a sound or noise of air leaking from between a donor sheet and mound portions after the donor sheet winding and before drum high speed rotation.

In the Table, circle (○) indicates a case in which the air leak sound or noise was same level as that in the conventional example, triangle (Δ) indicates a case in which the air leak sound or noise was louder than that in the conventional example, and cross(X) indicates a case in which the donor sheet has been blown off or peeled off.

TABLE 1

| | Evaluation Results | | | | | |
|---|---|---|---|---|---|---|
| | $r_s - r_d$ μm | d − s μm | (d − s) − ($r_s - r_d$) μm | Adhesion Test Results | Air-leak Test Results | Re-marks |
| Conventional Example | 0 | 110 | 110 | — | — | |
| Comparative Example 1-1 | 20 | 110 | 90 | X (3/5) | ○ | |
| Actual Example 1-2 | 40 | 110 | 70 | X (1/5) | ○ | |
| Actual Example 1-3 | 60 | 110 | 50 | ○ (0/5) | ○ | |
| Actual Example 1-4 | 80 | 110 | 30 | ○ (0/5) | ○ | |
| Actual Example 1-5 | 100 | 110 | 10 | ○ (0/60) | ○ | |
| Actual Example 1-6 | 120 | 110 | −10 | ○ (0/5) | ○ | |
| Actual Example 1-7 | 140 | 110 | −30 | ○ (0/5) | ○ | |
| Actual Example 2-1 | 160 | 110 | −50 | ○ (0/5) | Δ | |
| Actual Example 2-2 | 300 | 110 | −90 | ○ (0/5) | Δ | |
| Actual Example 2-3 | 3500 | 110 | −3390 | ○ (0/5) | Δ | |
| Comparative Example 1-8 | −90 | 0 | 90 | X (2/5) | ○ | |
| Comparative Example 1-9 | −70 | 0 | 70 | ○ (0/5) | ○ | |
| Comparative Example 1-10 | 30 | 0 | −30 | ○ (0/5) | ○ | |
| Actual Example 2-4 | 50 | 0 | −50 | ○ (0/5) | Δ | |
| Actual Example 2-5 | 90 | 0 | −90 | ○ (0/5) | Δ | |
| Actual Example 3-1 | −220 | −150 | 70 | ○ (0/5) | Δ | No mound portions |
| Actual Example 3-2 | −120 | −150 | −30 | ○ (0/5) | Δ or X | No mound portions |

As can be seen from the above-mentioned results, the optimum conditions relating to structure relations between a drum and a squeeze roller are as follows.

(1) Each boundary between smaller diameter portions having radius $r_d$ and a middle portion having the radius $r_s$ of a squeeze roller should be located in the vicinity of a respective side edge of a image-receiving sheet being wound around the drum.

(2) The radius $r_s$ of the middle portion and the radius $r_d$ of the smaller diameter portions sandwiching the middle portion, of the squeeze roller should satisfy a relation of $r_s - r_d > 0$ μm.

(3) The following relation, where the height of the mound portions is d and the thickness of the image-receiving sheet is s, should be satisfied.

$$-30\ \mu m<(d-s)-(r_s-r_d)<70\ \mu m$$

(4) A relation d≧s should be satisfied.

By disposing on a squeeze roller 334 a smaller diameter portion 336 at each end of the squeeze roller axial direction so that the above conditions or requirements are met, it is possible to eliminate air bubbles that may be generated between the image-receiving sheet 140 and the donor sheet 240. Thus, it becomes possible to prevent a poor picture (uneven recording) being produced due to poor adhesiveness.

Incidentally, the donor sheet 240 which has been undergone the above-described transfer process is removed from the drum 310 and then fed to the discharge section 400, where it is disposed of in the scrap box 40 which is provided outside the body cover 10.

Next, a donor sheet 240 with different color is separately wound around the image-receiving sheet 140 which has already been wound around the drum 310. In the same way, by laser-exposure, a donor ink of the donor sheet 240 is transferred onto the image-receiving sheet 140, and thereafter, the donor sheet 240 is removed and discharged from the drum.

The above-mentioned sequence of processing is repeated with respect to a predetermined number of kinds of donor sheets 240. If, for example, four types (i.e., yellow, magenta, cyan and black) of donor sheets are used, a color image will be formed on a image-receiving sheet 140.

Thereafter, the image-receiving sheet 140 onto which the number of kinds of donor inks has transferred is removed from the drum. This removal of the image-receiving sheet 140 is carried out in the same manner as that of the donor sheet 240. The removed image-recording sheet 140 is fed to the discharge section 400, where it is turned in a different direction and finally discharged onto the tray 50 of the upper portion of the cover body 10.

What is claimed is:

1. An image recording apparatus in which ink transfer from a donor sheet to an image-receiving sheet is carried out, the donor sheet having a larger size than the image-receiving sheet, the image recording apparatus comprising:

a rotating drum around which the image-receiving sheet and the donor sheet are laminatingly wound in this order;

a squeeze roller which is disposed to releasably press the donor sheet and the image-receiving sheet against the drum and has a middle portion in an axial direction of the squeeze roller having a substantially constant radius and a smaller diameter portion at at least one end thereof in the axial direction;

wherein the drum includes a first protruding mound portion which, when the image-receiving sheet and the donor sheet are wound around the drum, is spaced apart from an edge of the image-receiving sheet substantially by a predetermined distance and is in surface-contact with the donor sheet, and when the squeeze roller is pressing the donor sheet and the image-receiving sheet against the drum, a boundary portion between the smaller diameter portion and the middle portion of the squeeze roller is disposed at a side of the first mound portion at which the image-receiving sheet is disposed.

2. The image recording apparatus of claim 1, wherein, when the squeeze roller is pressing the donor sheet and the image-receiving sheet against the drum, the boundary portion of the squeeze roller substantially opposes the edge of the image-receiving sheet.

3. The image recording apparatus of claim 1, wherein, if the radius of the squeeze roller middle portion is $r_s$ and the radius of the smaller diameter portion is $r_d$, then $r_s-r_d>0$.

4. The image recording apparatus of claim 1, wherein, if the radius of the squeeze roller middle portion is $r_s$, the radius of the smaller diameter portion is $r_d$, a height of protruding of the first mound portion is d, and the thickness of the image-receiving sheet is s, then $$-30\ \mu m<\{(d-s)-(r_s-r_d)\}<+70\ \mu m.$$

5. The image recording apparatus of claim 1, wherein a protrusion height of the first mound portion is not less than the thickness of the image-receiving sheet.

6. The image recording apparatus of claim 1, wherein the drum further comprises a second mound portion disposed at a side of the first mound portion opposite to the side thereof at which the image-receiving sheet is wound.

7. The image recording apparatus of claim 6, wherein, when the donor sheet is wound around the drum, the second mound portion is in surface-contact with the donor sheet.

8. The image recording apparatus of claim 6, wherein at least one through-hole for suction-adhering of the donor sheet is provided in the drum surface between the first mound portion and the second mound portion.

9. The image recording apparatus of claim 1, wherein at least one through-hole for suction-adhering of the donor sheet is provided in the drum surface at a side of the first mound portion at which the image-receiving sheet is disposed.

10. The image recording apparatus of claim 1, further comprising a light source unit for irradiating a light beam towards the drum surface for ink transfer.

11. The image recording apparatus of claim 10, further comprising a drive unit for rotating the drum relative to the light source unit.

* * * * *